US007997333B2

(12) United States Patent
Angelle et al.

(10) Patent No.: US 7,997,333 B2
(45) Date of Patent: Aug. 16, 2011

(54) SEGMENTED BOTTOM GUIDE FOR STRING ELEVATOR ASSEMBLY

(75) Inventors: Jeremy R. Angelle, Lafayette, LA (US); Donald E. Mosing, Lafayette, LA (US)

(73) Assignee: Frank's Casting Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 11/846,169

(22) Filed: Aug. 28, 2007

(65) Prior Publication Data

US 2009/0057032 A1 Mar. 5, 2009

(51) Int. Cl.
*E21B 19/07* (2006.01)
*E21B 19/24* (2006.01)

(52) U.S. Cl. ..... 166/77.52; 166/85.5; 175/423; 294/102.2

(58) Field of Classification Search ..... 166/77.1, 166/77.14, 77.52, 77.53, 85.1, 85.5; 294/102.2; 175/423
See application file for complete search history.

(56) References Cited

U.S. PATENT DOCUMENTS

| | | | | |
|---|---|---|---|---|
| 370,744 | A | 9/1887 | Mixer | |
| 1,280,850 | A | 10/1918 | Robichaux et al. | |
| 1,446,568 | A | 2/1923 | Krell | |
| 1,548,543 | A * | 8/1925 | Moody | 166/85.1 |
| 1,669,401 | A | 5/1928 | Davis | |
| 2,048,209 | A | 7/1936 | Young et al. | |
| 2,065,140 | A | 12/1936 | Lundeen | |
| 2,263,364 | A * | 11/1941 | Nichols | 294/102.2 |
| 2,578,056 | A | 12/1951 | French | |
| 2,810,178 | A * | 10/1957 | Taylor | 188/67 |
| 2,852,301 | A | 9/1958 | Gentry | |
| 3,043,619 | A * | 7/1962 | George et al. | 294/90 |
| 3,167,137 | A | 1/1965 | Humphrey | |
| 3,424,257 | A | 1/1969 | Kotlyarov et al. | |
| 3,454,297 | A * | 7/1969 | Turner, Jr. | 294/90 |
| 3,457,605 | A | 7/1969 | Kingsbury et al. | |
| 3,472,535 | A | 10/1969 | Kinley et al. | |
| 3,495,864 | A | 2/1970 | Jones et al. | |
| 3,748,702 | A | 7/1973 | Brown | |
| 4,306,339 | A * | 12/1981 | Ward | 188/67 |
| 4,449,596 | A | 5/1984 | Boyadjieff | |

(Continued)

FOREIGN PATENT DOCUMENTS

DE 3537471 C1 10/1985

(Continued)

OTHER PUBLICATIONS

VARCO, excerpts from service manual, pp. 4 &7.

(Continued)

*Primary Examiner* — Kenneth Thompson
(74) *Attorney, Agent, or Firm* — Osha • Liang LLP

(57) ABSTRACT

The present invention is directed to a segmented bottom guide for directing the top of a tubular member into and through a bore in the bottom of a tapered bowl so that the tubular member can be engaged by pipe slips. One embodiment of the segmented bottom guide of the present invention comprises a bottom guide retainer having a plurality of chambers for being disposed intermediate the top of a bell guide and the bottom of the tapered bowl. The bottom guide segments are radially received into, and securable in, the retainer to therein and together form a generally conical frustum generally aligned with and intermediate the top of the bell guide and the opening of the tapered bowl.

49 Claims, 6 Drawing Sheets

U.S. PATENT DOCUMENTS

| | | | | |
|---|---|---|---|---|
| 4,511,168 | A * | 4/1985 | Haynes | 294/102.2 |
| 4,654,950 | A | 4/1987 | Maidlow | |
| 4,715,456 | A | 12/1987 | Poe, Jr. et al. | |
| 5,005,650 | A * | 4/1991 | Hopper | 166/339 |
| 5,107,931 | A * | 4/1992 | Valka et al. | 166/342 |
| 5,848,647 | A | 12/1998 | Webre et al. | |
| 6,394,186 | B1 | 5/2002 | Whitelaw et al. | |
| 6,394,201 | B1 | 5/2002 | Feigel, Jr. et al. | |
| 6,651,737 | B2 | 11/2003 | Bouligny et al. | |
| 6,814,149 | B2 | 11/2004 | Liess et al. | |
| 6,994,176 | B2 | 2/2006 | Shahin et al. | |
| 7,143,849 | B2 | 12/2006 | Shahin et al. | |
| 7,383,885 | B2 | 6/2008 | Bergeron et al. | |
| 7,395,855 | B2 | 7/2008 | Ayling | |
| 7,546,884 | B2 | 6/2009 | Veeningen et al. | |
| 2004/0016575 | A1 | 1/2004 | Shahin | |
| 2004/0200622 | A1 | 10/2004 | Jennings | |
| 2004/0251055 | A1 | 12/2004 | Shahin et al. | |
| 2006/0225891 | A1 | 10/2006 | Adams et al. | |
| 2008/0174131 | A1 * | 7/2008 | Bouligny et al. | 294/88 |
| 2009/0252589 | A1 | 10/2009 | Sonneveld et al. | |
| 2010/0059231 | A1 | 3/2010 | Thomas et al. | |
| 2010/0101805 | A1 | 4/2010 | Angelle et al. | |

FOREIGN PATENT DOCUMENTS

| | | | |
|---|---|---|---|
| EP | 1619349 | A2 | 1/2006 |
| EP | 2163722 | A1 | 3/2010 |
| WO | W003031766 | A1 | 4/2003 |
| WO | 2007081952 | A1 | 7/2007 |

OTHER PUBLICATIONS

Angelle, Jeremy, co-pending U.S. Appl. No. 12/126,072 "Adjustable Pipe Guide For Use With An Elevator and/or A Spider", 46 pages.

PCT International Search Report and Written Opinion, Feb. 17, 2009, pp. 1-13.

Jeremy R. Angelle, "U.S. Appl. No. 12/126,072 Non-Final Office Action" dated May 28, 2009, 13 pages.

Angelle, Jeremy, U.S. Appl. No. 12/618,705, filed Nov. 13, 2009 "Method of Running a Pipe String Having an Outer Diameter Transition".

U.S. Appl. No. 12/126,072, "Non-Final Office Action, mailed May 28, 2009", 6 pages.

Frank's International, Inc. "PCT/US2008/074639 International Preliminary Report on Patentability", Mar. 2, 2010, 6 pages.

Frank's International, Inc. "Application No. EP10154443—European Search Report", The Hague (Patrick Dantinne), Apr. 21, 2010, 7 pages.

2M-Tek Tubular Systems "FLUSH-TEK(TM) Model S-503", Brochure, www.2m-tek.com, May 31, 2009, 2 pages.

Weatherford "Real Results—RMS 2400 Elevator and Flush-Mounted Spider Enhances Safety in Deepwater Gulf of Mexico", Weatherford Dec. 3, 2008, 1 page.

Notice of Allowance in U.S. Appl. No. 12/126,072; dated Dec. 28, 2010 (6 pages).

Office Action in U.S. Appl. No. 12/126,072; dated Sep. 30, 2010 (5 pages).

Office Action in U.S. Appl. No. 12/618,705; dated Sep. 16, 2010 (7 pages).

Office Action in U.S. Appl. No. 12/126,072; dated Mar. 18, 2010 (6 pages).

Weatherford, "Tubular Running Services: UniSlips", Weatherford.com 2010 (2 pages).

EPO communication dated Jan. 31, 2011, issued by the European Patent Office in Application No. 08829182.8 (6 pages).

PCT International Search Report and Written Opinion, dated Jan. 26, 2011 in International Application No. PCT/US2010/033222 (9 pages).

Office Action in European Patent Application No. 10154443.5-1266; dated Apr. 8, 2011 (5 pages).

Notice of Allowance in U.S. Appl. No. 12/126,072; dated Apr. 14, 2011 (13 pages).

Notice of Allowance in U.S. Appl. No. 12/618,705; dated Apr. 14, 2011 (15 pages).

* cited by examiner

SEGMENTED BOTTOM GUIDE FOR STRING ELEVATOR ASSEMBLY

BACKGROUND

1. Field of the Invention

The present invention is directed to a segmented bottom guide for a string elevator assembly used to handle pipe strings to drill and complete a borehole for recovery of oil or gas. Specifically, the present invention is directed to a segmented bottom guide for directing the top of a tubular member into and through a bore so that the tubular member can be engaged by pipe slips within the string elevator.

2. Background of the Related Art

Wells are drilled to establish a conduit between the surface and a targeted geologic feature such as a hydrocarbon reservoir. Casing strings are made up and installed in the drilled borehole to prevent collapse, cross-flow from one geologic formation to another, and to isolate the interior of the well from corrosive fluids present in some penetrated geologic formations. Generally, a pipe string is suspended in a borehole and lengthened by threadedly joining a pipe segment to the proximal end of the pipe string at the rig. The lengthened pipe string is then lifted to unload the spider that suspends the pipe string, and the lengthened string is lowered further into the borehole. The spider again engages and supports the pipe string as additional pipe segments are joined to farther lengthen the pipe string.

Special tools exist for positioning a pipe segment to be threadedly joined to the proximal end of the suspended pipe string. In one well known method, a pipe segment is secured to a lift line that hoists the pipe segment into the derrick to dangle the lower end of the pipe segment near the proximal end of the pipe string. The lower "pin" end of the pipe segment is positioned by rig personnel to be received into and bear against the proximal "box" end of the pipe string suspended by the spider in the borehole. A "stabber" is a member of the rig crew that works in the derrick. The stabber is secured to the derrick to prevent him from falling as he leans out to manually position the top "box end" of the pipe segment to align it with the pipe string. A power tong may be used to grip and rotate the pipe segment about its axis to make up the threaded connection between the lower "pin end" of the pipe segment and the proximal box end of the pipe string to lengthen the pipe string. The stabber then aligns the top box end of the now-connected pipe segment into the bell guide of the string elevator so that the box end of die pipe segment can be directed into the gripping portion of the string elevator as the string elevator is lowered over the end of the pipe segment. Once the string elevator is lowered enough to engage and grip the upper end of the pipe segment (which is now the new proximal end of the lengthened pipe string), the string elevator lifts the entire pipe string to unload the spider, and then it lowers the pipe string to install the lengthened pipe string further into the borehole.

When the string elevator nears the spider, the spider may reengage and support the pipe string to strategically position the new proximal end of the now-lengthened pipe string above the spider to receive and couple to a new pipe segment. This method of forming and installing a pipe string in a borehole is repeated until the pipe string reaches its desired length.

The string elevator used in the method described above is adapted to receive the proximal end of a lengthened pipe string from below, and to be lowered over the end of the proximal end of the pipe string as it is positioned by the stabber for being received into the elevator. After the proximal end of the pipe string is received into the tapered bowl, it may be releasably gripped using a set of slips that have been moved upwardly and radially outwardly from the center of the tapered bowl to receive the pipe string, and that can be engaged by moving downwardly and radially inwardly within the tapered bowl to engage and grip the pipe string. The proximal end of the pipe string must generally be carefully positioned by the stabber to ensure that it enters the string elevator from beneath as the string elevator is lowered using a drawworks. After the pipe segment is threadedly connected to the exposed proximal end of a pipe string, the pipe string is lengthened, and the new proximal end of the pipe string is positioned high above the rig floor. The proximal end is then guided through the opening in the bottom of the tapered bowl and into the tapered bowl so that the lengthened pipe string can be gripped and then lifted up to unload the spider.

The insertion of the proximal end of the lengthened pipe string into the opening in the bottom of the tapered bowl has to be done at a position far above die rig floor where it is impractical for rig personnel to physically guide the proximal end of the pipe string into the opening in the bottom of the tapered bowl. For this reason, the string elevator is generally provided with structures adapted for guiding the proximal end of the lengthened pipe string into and through the opening so that the proximal end of the pipe string can be gripped by the slips within the tapered bowl. A bell guide is a generally hollow interior conical frustum for receiving and guiding the top end of the lengthened pipe string toward the opening in the tapered bowl of the string elevator.

The bottom guide is a second structure for cooperating with the bell guide in guiding the top end of the pipe string into the opening of the tapered bowl. The bottom guide is secured between the bell guide and the opening in the bottom of the tapered bowl to receive the top end of the pipe string after it leaves the bell guide and to further direct it to the opening. Since most string elevators can be "dressed" or modified using inserts, spacers and sleeves to grip and lift a range of pipe diameters, the diameter of the opening in the bottom of the tapered bowl may vary depending on the diameter of the pipe string being made tip and run into the borehole. For this reason, the bottom guide may be replaceable to enable the use of an appropriately-sized bottom guide for receiving the top end of the pipe string from the top of the bell guide and guiding it to the opening in the tapered bowl. The bottom guide must have the appropriate size and taper for guiding the received top end of the pipe string to the opening.

However, depending on its capacity, the string elevator may weigh up to 15,000 pounds or more. Similarly, the slips, the bell guide and the bottom guide each may weigh hundreds of pounds. Replacing, the heavy bottom guide can be difficult and time consuming, not only because of the weight, but also because the bottom guide is generally positioned between the bell guide and the tapered bowl, and access to the bottom guide often requires removing the bell guide and removing fasteners from underneath the heavy tapered bowl. Once removed from the tapered bowl, the bottom guide may be very heavy and difficult to handle. The bottom guide may require removal of other heavy components, such as the bell guide, to provide access to the bottom guide. For example, one commercially available string elevator requires removal of the heavy slips to replace the bottom guide. Other string elevators require that the string elevator be suspended for replacing the bottom guide, and personnel replacing the bottom guide must work with their hands underneath the suspended string elevator, thereby exposing personnel to potential danger or, at the very least, a difficult working position.

What is needed is a string elevator assembly that provides easier access to the bottom guide so that the bottom guide profile can be adapted to guide the top end of a pipe string from the top of a bell guide to the opening in the bottom of the tapered bowl. What is needed is a string elevator assembly that facilitates the replacement of the bottom guide without exposing rig personnel to unnecessary danger or difficult working positions. What is needed is a more versatile string elevator assembly that includes a bottom guide that can be safely replaced to accommodate a range of pipe diameters.

SUMMARY

The present invention satisfied some or all of the above-stated needs, and others. The present invention comprises a string elevator assembly having a bottom guide intermediate a bell guide and a tapered bowl that is segmented to facilitate radial installation mid radial removal of the bottom guide segments to form and remove an interior conical frustum for guiding the end of a pipe into the tapered bowl of a string elevator. The bottom guide segments are adapted for being, captured within a retainer that couples the bell guide to the tapered bowl of the string elevator. The present invention comprises a segmented bottom guide for use in aligning the top end of a pipe for being received into an opening within the tapered bowl of a vertically positionable string elevator. The bottom guide of the present invention comprises a retainer that comprises a plurality of chambers therein, each for receiving and retaining a bottom guide segment. Each bottom guide segment comprises a curved face that forms, together with the curved faces of the other bottom guide segments, a portion of a conical frustum to funnel and guide the top end of a pipe string from the top of a bell guide to the opening in the bottom of a tapered bowl in which the pipe string is to be gripped. The conical frustum formed by the curved faces of the retained bottom guide segments form a generally convergent interior surface to contact and guide the top end of the pipe string as the string elevator assembly is lowered downwardly to receive and direct a pipe string into the tapered bowl. Once the pipe string has been successfully directed to the bore of the tapered bowl, the slips received within the tapered bowl are closed to grip and support the pipe string.

So that the manner in which the above recited features of the present invention can be understood in detail a more particular description of the invention, briefly summarized above, may be had by reference to embodiments, some of which are illustrated in the appended drawings. However, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
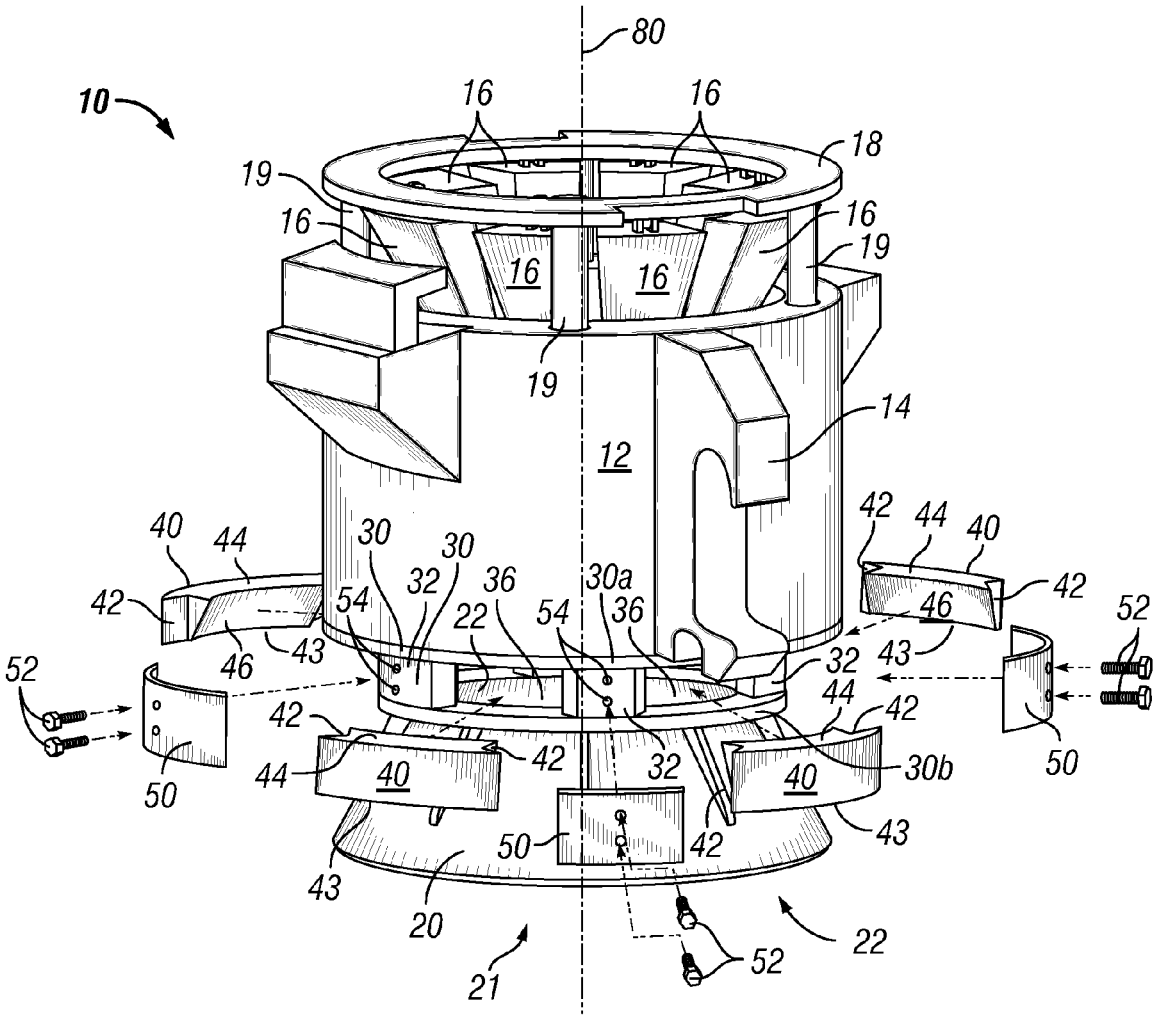
FIG. 1 is a perspective exploded view of one embodiment of the string elevator assembly of the present invention.

FIG. 1 is one embodiment of a string elevator assembly 10 of the present invention having a tapered bowl 12, a plurality of slips 16 for movement radially inwardly and downwardly within the tapered bowl 12 to grip and support a pipe string (not shown in FIG. 1) received into the string elevator along its axis 80 and introduced through the bottom 21 of a bell guide 20. The string elevator assembly 10 is supportable above a rig floor by bails (not shown in FIG. 1) that may engage and support lift ears 14. The bails are not shown in FIG. 1 to reveal the string elevators assembly 10 in more detail.

Figure 9:
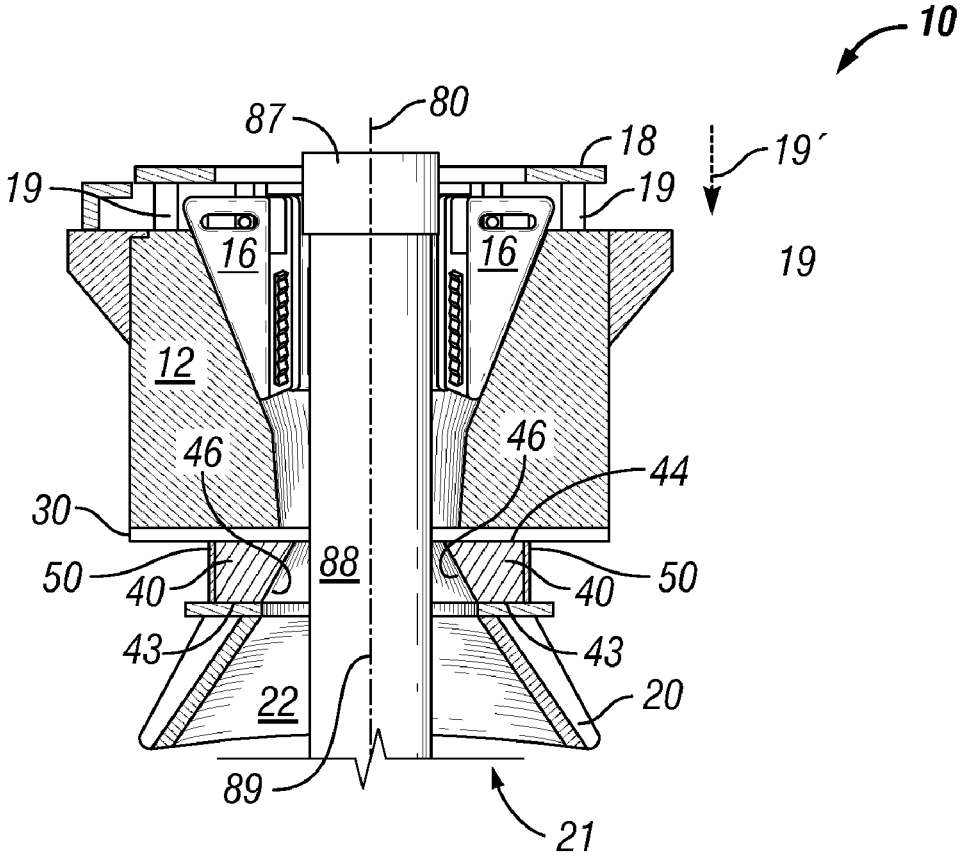
FIG. 9 is the elevation view of FIG. 8 illustrating the position of the pipe string after further movement of the string elevator assembly downwardly to insert the end of the pipe string into the tapered bowl where it is gripped by engagement of the slips.

The slips 16 are movable between an engaged position and a disengaged position (shown in FIG. 1) using a timing ring 18. The timing ring 18 may be actuated downwardly by retraction of rods 19 into the wall of the tapered bowl 12 to engage the slips 16 against the exterior surface of a pipe string 88 (not shown in FIG. 1). Subsequently, the string elevator assembly 10 may be disengaged from the pipe string 88 by extending rods 19 upwardly from the wall of the tapered bowl 12 to disengage the slips 16 from the pipe string (not shown). The rods 19 may be hydraulically, pneumatically or mechanically actuated to elevate and thereby disengage the slips 16 from the pipe string, and may be hydraulically, pneumatically, mechanically or gravitationally actuated to lower and thereby engage the slips 16 with the pipe string. FIG. 9 illustrates the position of the timing ring 18, the rod 19 and the slips 16 when in the engaged position, and the direction 19' of movement of the timing ring 18 to engage the slips with the pipe string 88.

Returning again to FIG. 1, the string elevator assembly 10 comprises a retainer 30 that may be coupled at its bottom **30*b* to the bell guide 20 and at its top 30*a* to the tapered bowl 12, or to an intermediate member connected thereto. The retainer 30 comprises a plurality of generally radially extending supports 32 disposed intermediate the top 30*a* and the bottom 30*b* of the retainer 30 to provide support for the bell guide 20 when it is coupled to the tapered bowl 12. A plurality of chambers 36 are formed between the supports 32, each for receiving and retaining a bottom guide segment 40 in a generally assembled arrangement with the other bottom guide segments. Each bottom guide segment 40 comprises a curved face 46 intermediate opposed notched ends 42. The curved faces 46 of the bottom guide segments 40, when the bottom guide segments 40 are retained within the chambers 36 of the retainer 30, together form a generally continuous section of the interior of a conical frustum that has a bottom disposed toward the top of the bell guide 20 and a lop disposed toward the tapered bowl 12, and having convergence in the direction of the top so as to funnel and guide the end of a pipe received within the interior 22 of the bell guide 20 toward an opening (not shown in FIG. 1) in the bottom of the tapered bowl 12**.

Figure 2:
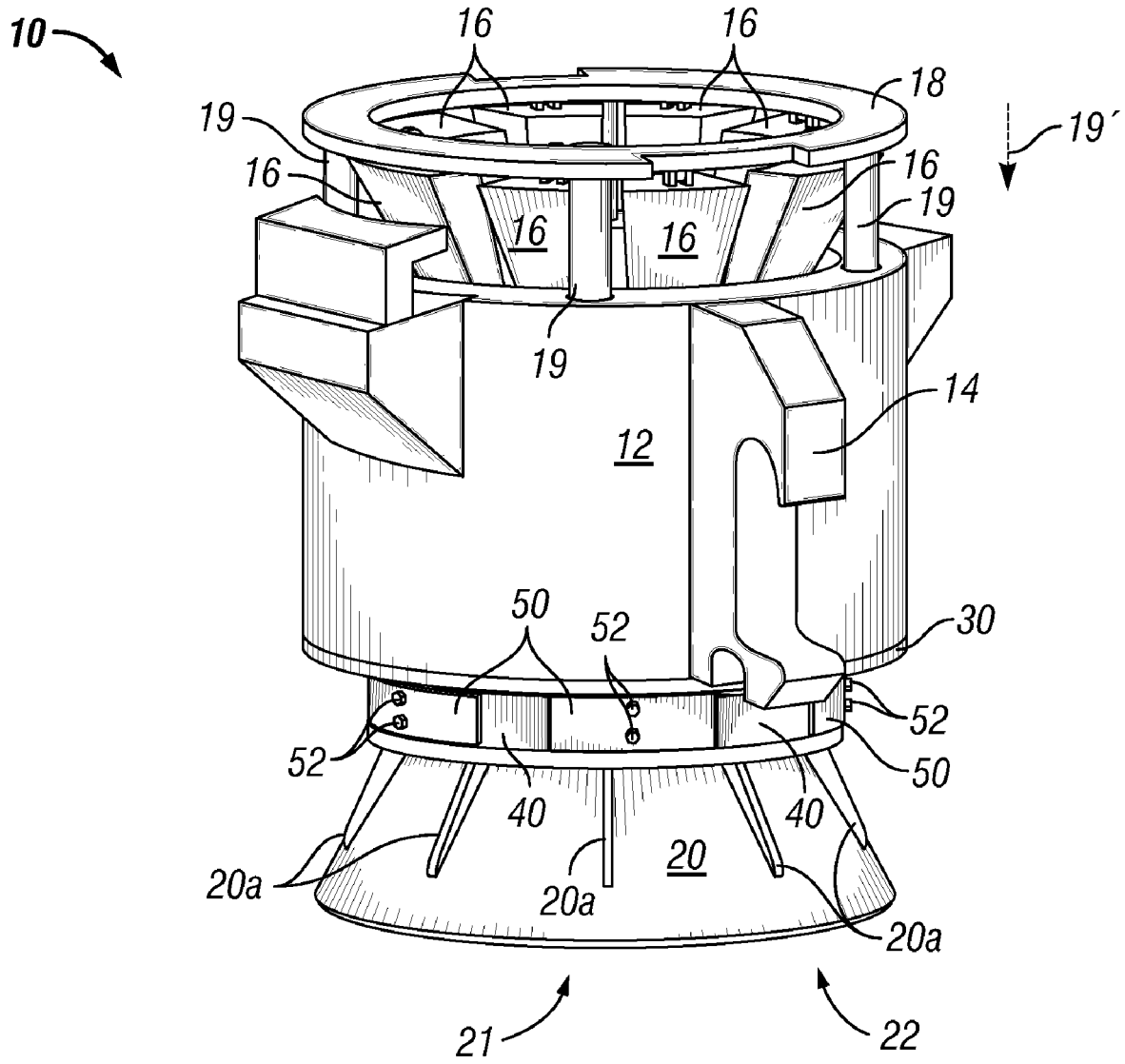
FIG. 2 is an assembled perspective view of the string elevator assembly of FIG. 1.

FIG. 2 illustrates the configuration of the string elevator assembly 10 of FIG. 1 after it is assembled for use in forming and lengthening a pipe string. The bottom guide segments 40 are retained within the chambers 36 of the retainer 30 using curved retainer plates 50 that are securable to the retainer 30 using bolts 52 that are threadedly receivable into corresponding threaded holes 54 the supports 32. Each curved retainer plate 50 comprises a pair of generally aligned apertures for receiving bolts 52, and each bottom guide segment 40 is securable within a chamber 36 by the adjacent ends of each of the adjacent curved retainer plates 50. It should be understood that the bottom guide segments 40 are securable within the chambers 36 using a variety of fasteners and retainers.

The notched ends 42 of each bottom guide segment 40 may be shaped or contoured to cooperate with a corresponding shape or contour of the supports 32 located on either side of the chamber 36 of the retainer 30 in which the bottom guide segment is to be radially received. These corresponding shapes of the notched ends 42 and the supports 32 may assist in positioning the bottom guide segment 40 within the chamber 36. Similarly, the top 42 and the bottom 43 of each bottom guide segment 40 may be shaped or contoured to cooperate with a corresponding shape or contour within the retainer 30 in which the bottom guide segment 40 is received and retained. In FIG. 2, the top 42 and the bottom 43 of each bottom guide segment 40 are smooth to facilitate simple sliding insertion and removal of each bottom guide segment 40 from a chamber 36 of the retainer 30.

Figure 3:
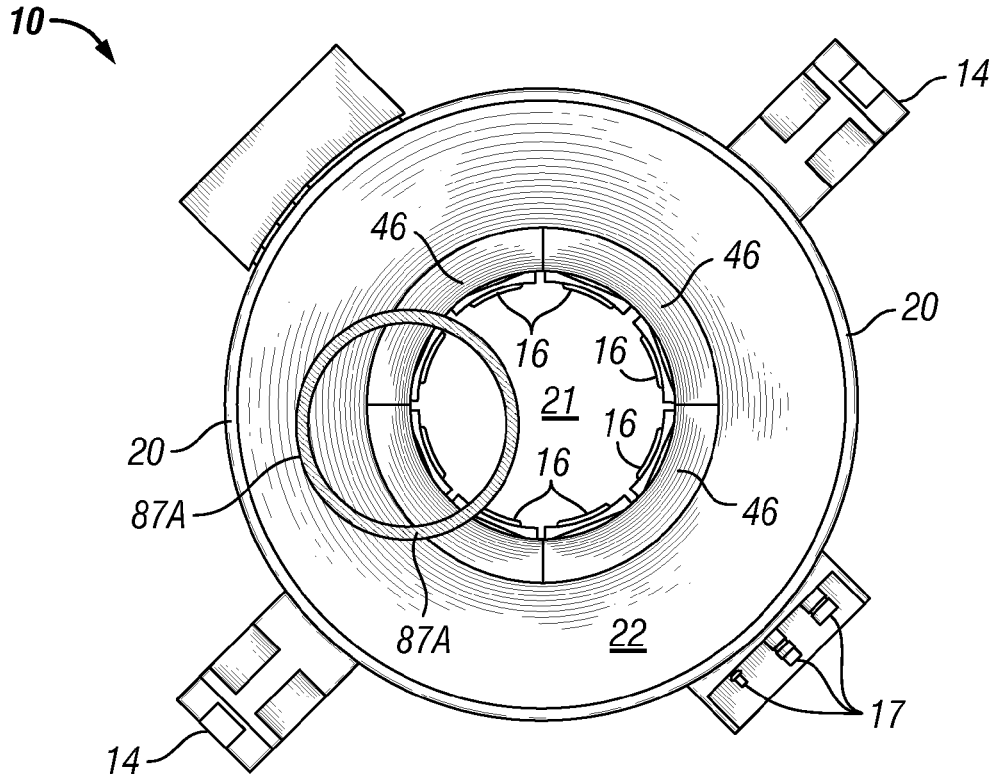
FIG. 3 is a bottom view of the string elevator assembly of FIG. 2, further having a circle indicating the position of the end of a pipe string received into the bell guide and corresponding to the position of the pipe string in FIG. 6.
Figure 4:
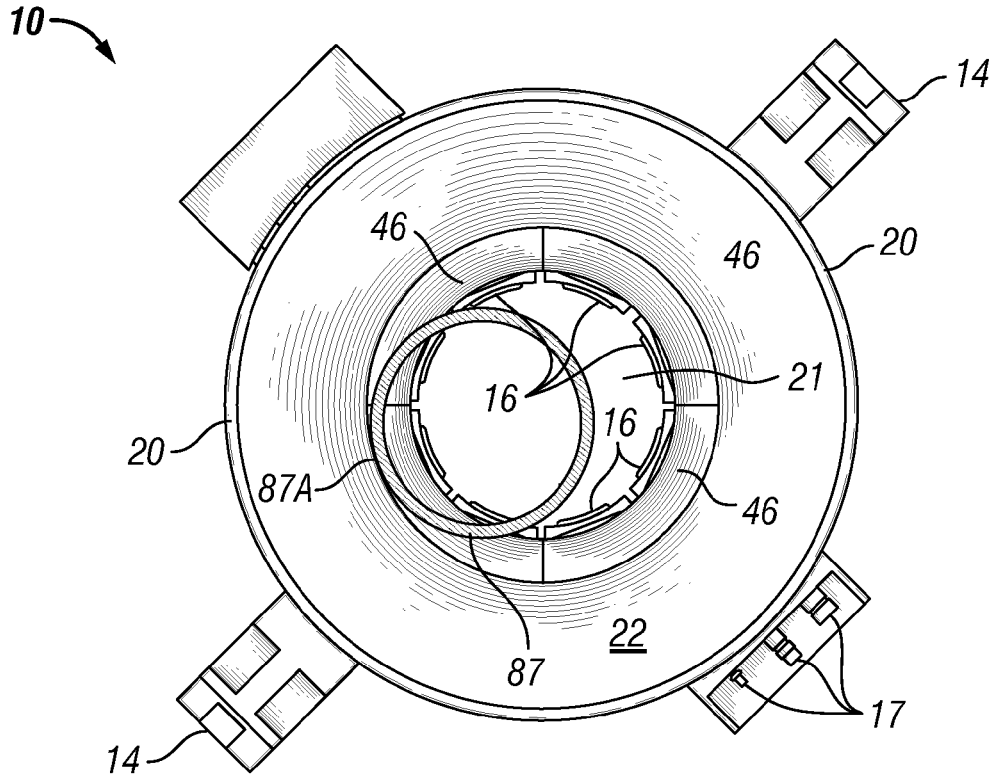
FIG. 4 is the bottom view of FIG. 3 illustrating the movement of the end of the pipe string within the bell guide and to the interface between the bell guide and the bottom guide that surrounds the opening in the bottom of the tapered bowl. The circle indicating the position of the end of the pipe string corresponds to the position of the pipe string in FIG. 7.
Figure 5:
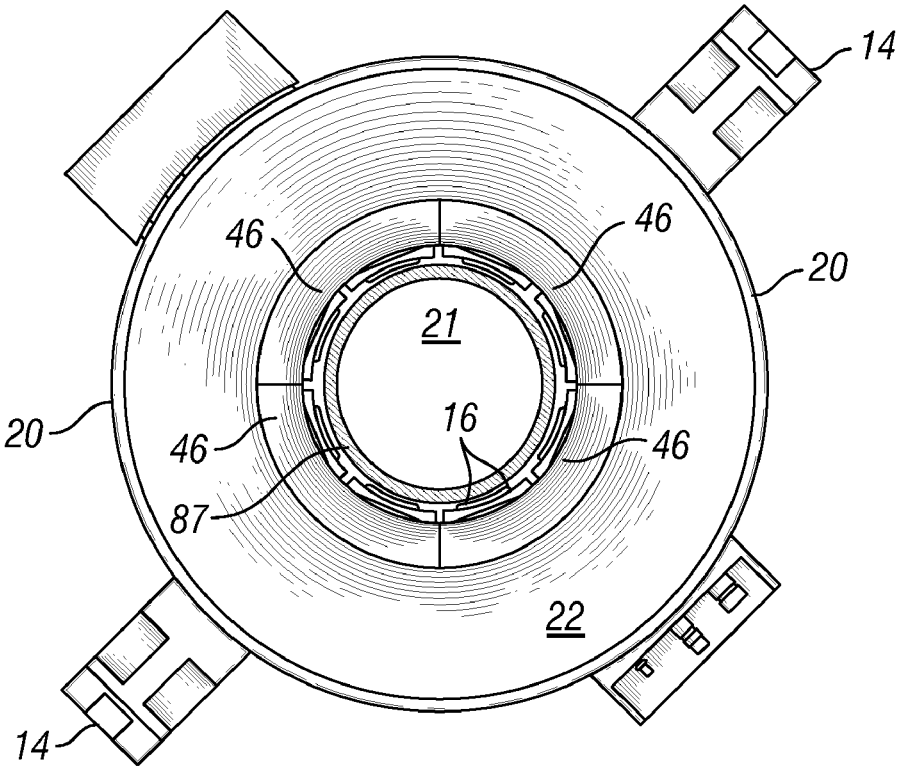
FIG. 5 is the bottom view of FIG. 4 illustrating further movement of the end of the pipe string as guided by the bottom guide to a position aligned with the opening in the bottom of the tapered bowl. The circle indicating the position of the end of the pipe string corresponds to the position of the pipe string in FIG. 8.
Figure 6:
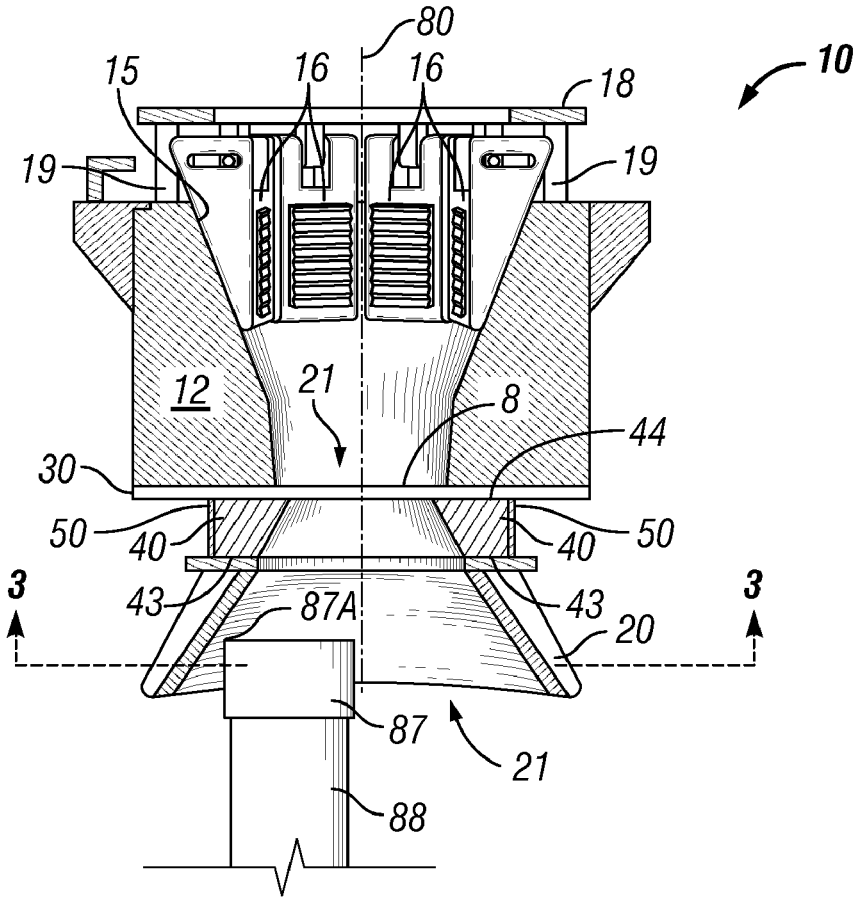
FIG. 6 is the elevation view corresponding to FIG. 3 illustrating the position of the pipe string received within the bell guide for being guided into a bottom guide surrounding an opening in the bottom of the tapered bowl.
Figure 7:
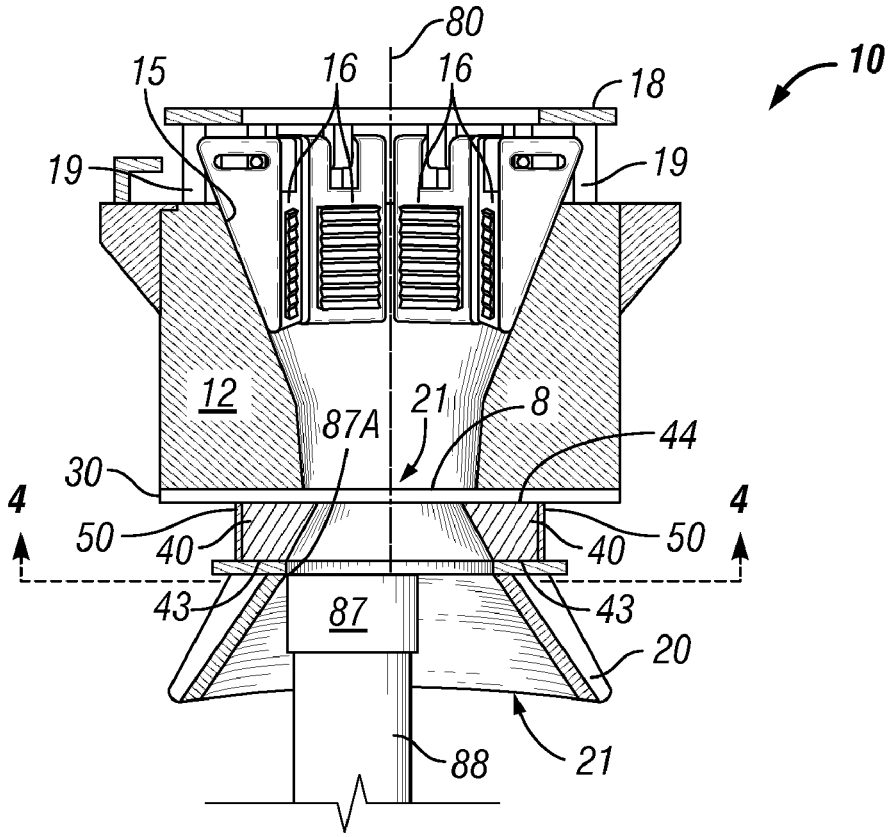
FIG. 7 is the elevation view corresponding to FIG. 4 illustrating the position of the pipe string after movement of the string elevator assembly downwardly to further receive the pipe string.
Figure 8:
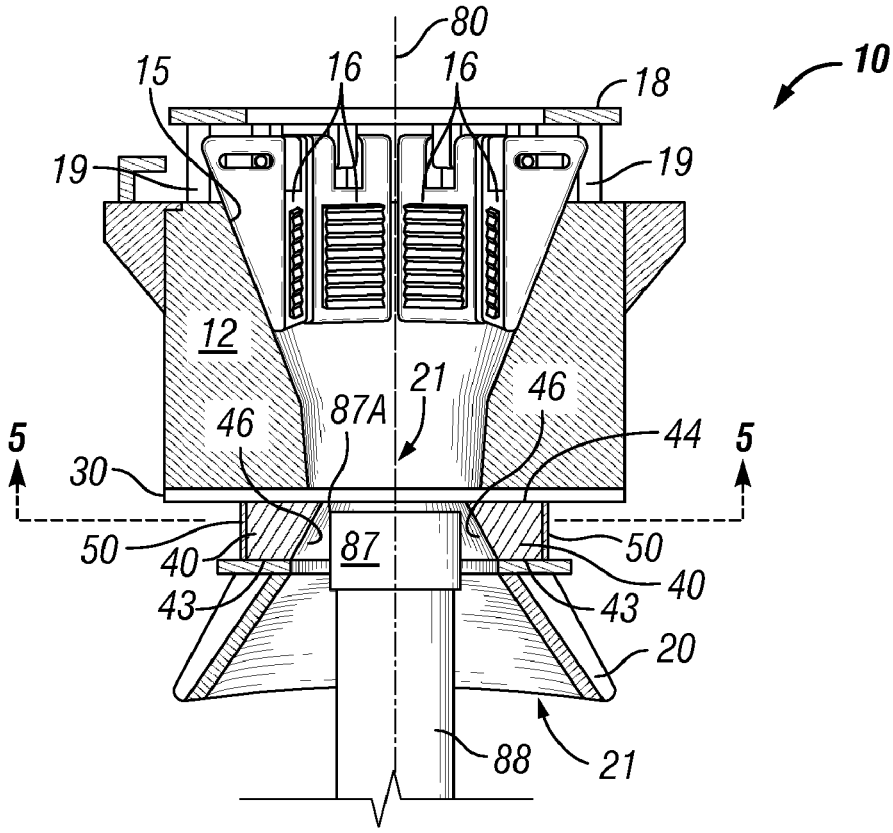
FIG. 8 is the elevation view corresponding to FIG. 5 illustrating the position of the pipe string after further movement of the string elevator assembly downwardly to further receive the pipe string.

FIGS. 3-5 are bottom views of the string elevator assembly 10 of the present invention corresponding to the elevation views of FIGS. 6-8. Each bottom view of FIGS. 3-5 shows the bell guide 20 having a generally interior conical frustum 22 and the generally axially aligned conical frustum formed by the faces 46 of the bottom guide segments 40 that are secured in an arrangement within the chambers 36 of the retainer 30 (not visible in FIGS. 3-5, see FIGS. 6-8). FIGS. 3-5 all show an arrangement of slips 16 within the tapered bowl 12 (not shown in FIGS. 3-5, see FIGS. 6-8). FIGS. 3-5 further show the generally axially aligned and the generally conically aligned interior surfaces of two separate conical frustums, one being the interior conical frustum 22 of the bell guide 20, and the other being the interior conical frustum formed by the curved faces 46 of the bottom guide segments 40 when the bottom guide segments 40 are retained within the chambers 36 of the retainer 30. The two conical frustums may be positioned one adjacent to the other as shown in FIGS. 3-5 to together form a single conical frustum, or they may be positioned to form two adjacent conical frustums, each having a slope different from the other, but generally converging in the same direction to guide the end of a pipe received therein to an opening 21 in the bottom of the tapered bowl 12 (see FIGS. 6-8).

FIG. 3 is a bottom view of the string elevator assembly 10 that corresponds to the elevation view of FIG. 6, and these figures together illustrate the position of the top end 87 of a pipe string 88 received within the bell guide 20 by lowering the string elevator assembly 10 downwardly to receive the pipe string 88 within the bell guide 20. The pipe string 88 is shown in FIG. 6 to be generally misaligned with the opening 21 and the cylinder defined by the slips 16 movably received within the tapered bowl 12 (not shown in FIG. 3). The opening 21 is generally aligned with the axis 80 of the tapered bowl 12. As the string elevator assembly 10 is lowered to receive the top end 87 of the pipe string 88 into the bell guide 20. The contact point 87A shows the initial point of contact between the interior conical frustum 22 of the bell guide 20 and the top end 87 of the pipe string 88 as the top end 87 slides generally upwardly and in the convergent direction of the conical frustum 22 toward the curved faces 46 of the bottom guide segments 40 to the position shown in FIG. 4.

FIG. 4 is a bottom view of the string elevator assembly 10 that corresponds to the elevation view of FIG. 7, and these together illustrate the position of the top end 87 of a pipe string 88 received within the bell guide 20 alter it slides upwardly along the interior surface of the conical frustum 22 of the bell, guide 20 from its position shown in FIGS. 3 and 6. The contact point 87A shown in FIG. 4 is shown to be generally contacting the interface between the curved faces 46 of the bottom guide segments 40 and the top of the conical frustum 22 of the bell guide 20. From this position, the adjacent conical frustum formed by the curved faces 46 of the bottom guide segments 40 will continue to guide the top end 87 of the pipe string 88 toward its position shown in the bottom view of FIG. 5 and the elevation view of FIG. 8 aligned with the opening 21 and with the cylinder defined by the slips 16 that are movably received within the tapered bowl 12.

FIG. 5 is a bottom view that corresponds to the elevation view of FIG. 8, and these together illustrate the position of the top end 87 of the pipe string 88 after the string elevator assembly 10 is lowered further from its position of FIG. 4, and after the pipe string 88 is further received within the bell guide 20 and the arrangement of the curved faces 46 of the bottom guide segments. The pipe string 88 is shown to be generally aligned with the axis of the bell guide 20 and the conical frustum formed by the arrangement of the bottom guide segments 40. The pipe string 88 is also aligned with the opening 21 and the cylinder defined by the slips 16 within the tapered bowl 12. The aligned condition of the pipe string 88 with the axis 80 of the tapered bowl 12 and the bore 21 defined by the slips 16 received therein permits the string elevator assembly 10 to be lowered further, and for the pipe string 88 to be inserted within the bore 21 by continued downward movement of the string elevator assembly 10 and then positioned to be gripped by movement of the slips 16 radially downwardly and inwardly within the tapered bowl 12, as shown in FIG. 9.

FIG. 9 is an elevation view of the string elevator assembly 10 of FIG. 8 after the string elevator assembly 10 is lowered further from its position of FIG. 8 to insert the top end 87 of the pipe string 88 through the opening 21 in the bottom of the tapered bowl 12.

While the foregoing is directed to embodiments of the present invention, other and further embodiments of the invention may be devised without departing from the basic scope thereof, and the scope thereof is determined by the claims that follow.

We claim:

1. An elevator assembly comprising:

a bowl having a tapered bore therethrough to receive and cooperate with a set of slips to grip a pipe to be supported by the elevator assembly, the tapered bore terminating at an opening;

a guide retainer having a bore therethrough disposed adjacent to the opening of the tapered bore; and a plurality of guide segments having a face and releasably secured on the guide retainer;

wherein the guide segments together form a generally convergent surface adjacent the opening of the tapered bore.

2. The elevator assembly of claim 1 wherein the guide retainer comprises a plurality of supports.

3. The elevator assembly of claim 2 wherein the plurality of supports extend generally radially from the bore of the guide retainer.

4. The elevator assembly of claim 3 wherein the plurality of supports are intermediate a top coupling and a bottom coupling of the guide retainer to facilitate coupling the guide retainer to the tapered bore and to a bell guide.

5. The elevator assembly of claim 4 wherein the top coupling is integral with the tapered bore.

6. The elevator assembly of claim 4 wherein the bottom coupling is integral with the bell guide.

7. The elevator assembly of claim 1 wherein the guide retainer radially receives the guide segments.

8. The elevator assembly of claim 4 wherein an interior of the bell guide comprises a first generally convergent surface and the faces of the guide segments are positionable within the guide retainer to together form a second generally convergent surface.

9. The elevator assembly of claim 1 wherein the plurality of guide segments are received within the guide retainer to together generally form a frustum.

10. The elevator assembly of claim 1 wherein the faces of the plurality of guide segments are curved about the bore of the guide retainer.

11. The elevator assembly of claim 1 wherein the generally convergent surface is a frustum.

12. The elevator assembly of claim 11 wherein the generally convergent surface is a conical frustum.

13. The elevator assembly of claim 1 wherein the guide segments comprise an end to position the guide segments relative to the guide segment retainer.

14. The elevator assembly of claim 1 wherein the face of the guide segments is curved about the bore of the body.

15. The elevator assembly of claim 1 further comprising:

a plurality of removably securable replacement guide segments having a face;

wherein the replacement guide segments are securable to the guide retainer to together form a second generally convergent surface adjacent the opening of the bore.

16. The elevator assembly of claim 9 wherein the frustum is a conical frustum.

17. An elevator assembly comprising:

an elevator body; and a guide retainer secured and disposed adjacent to the elevator body;

the guide retainer configured to removably secure a plurality of guide segments therewith;

wherein the plurality of guide segments form at least a portion of a generally convergent surface to steer a pipe toward a bore in the elevator assembly when secured within the guide retainer.

18. The elevator assembly of claim 17 further comprising a plurality of replacement guide segments to together form a second generally convergent surface to steer a second pipe toward the bore in the elevator assembly.

19. The elevator assembly of claim 17 wherein the plurality of guide segments comprise a curved face of a generally common pitch;

wherein the plurality of guide segments together generally form a frustum.

20. The elevator assembly of claim 17 wherein the guide retainer radially receives at least one of the plurality of guide segments from a radially outwardly position.

21. The elevator assembly of claim 17 wherein the plurality of guide segments are removably secured to the guide retainer using fasteners.

22. The elevator assembly of claim 17 wherein the plurality of guide segments are radially received onto the guide retainer and radially removed from the guide insert retainer.

23. The elevator assembly of claim 17 wherein a bell guide is secured underneath the elevator.

24. The elevator assembly of claim 17 wherein the generally convergent surface is a frustum.

25. The elevator assembly of claim 23 wherein an interior of the bell guide forms a first frustum and the plurality of guide segments received within the retainer together form a second frustum.

26. The elevator assembly of claim 17 further comprising a timing ring coupled to a set of slips and movable between an engaged position and a disengaged position within the bore of the elevator assembly.

27. The elevator assembly of claim 17 further comprising:

a bell guide coupled to the guide retainer.

28. The elevator assembly of claim 17 wherein the face of the plurality of guide segment is curved about a bore of the guide retainer.

29. The elevator assembly of claim 17 wherein the guide segments comprise a retainer plate.

30. The elevator assembly of claim 24 wherein the generally convergent surface is a conical frustum.

31. A guide assembly comprising:

a body having a bore;

a coupling to couple the body to an elevator body, the elevator body having a bore formed therein and a plurality of slips movably received therein; and a plurality of removable guide segments configured to be removably secured within the body;

wherein the plurality of removable guide segments together form a generally convergent surface to guide a pipe into the bore of the elevator body when secured within the body.

32. The guide assembly of claim 31 wherein the face of the plurality of removable guide segments is curved about the bore of the body.

33. The guide assembly of claim 31 wherein the generally convergent surface is a frustum.

34. The guide assembly of claim 33 wherein the generally convergent surface is a conical frustum.

35. The guide assembly of claim 31 wherein the face of the guide segments is curved about the bore formed by the set of slips of the elevator.

36. A method of guiding a pipe into an elevator movably suspended on a rig comprising the steps of:

securing a guide retainer to the elevator;

removably securing a plurality of guide segments within the guide retainer, the plurality of guide segments each comprising a generally convergent surface generally aligned with a bore of the elevator; and engaging an end of the pipe with the generally convergent surfaces of the plurality of guide segments to guide an end of the pipe into the bore of the elevator.

37. The method of claim 36 further comprising the step of:

moving a set of slips in the bore of the elevator to a gripping position to grip the pipe.

38. The method of claim 36 further comprising the step of:

replacing the plurality of guide segments with a second plurality of guide segments to together form a second generally convergent surface.

39. The method of claim 38 comprising the step of:

engaging an end of a different diameter pipe with the second generally convergent surface to guide the end of the different diameter pipe into the bore of the elevator.

40. The method of claim 36 wherein the end of the pipe is guided into the bore of the elevator by lowering the elevator using a draw works of the rig while engaging the end of the pipe with the generally convergent surface.

41. An apparatus comprising:

a guide retainer having a coupling that is configured to secure the guide retainer to a body of a pipe gripping apparatus, the pipe gripping apparatus comprising the body with a bore formed therein and having a plurality of slips coupled thereto; and a plurality of guide segments removably secured to the guide retainer;

wherein the plurality of guide segments together form a generally convergent surface to guide a portion of a pipe into the bore of the pipe gripping apparatus when secured to the guide retainer.

42. The apparatus of claim 41 wherein the generally convergent surface is a frustum.

43. The apparatus of claim 42 wherein the frustum is a conical frustum.

44. The apparatus of claim 41 further comprising:

a plurality of at least one of grooves or channels of the guide retainer to slidably receive the guide segments.

45. The apparatus of claim 41 wherein the guide retainer has a second coupling to secure a bell guide to the guide retainer.

46. The apparatus of claim 41 wherein the guide segments are radially received on the guide retainer.

47. The apparatus of claim 41 wherein the face of the plurality of guide segments is curved about a bore of the guide retainer.

48. The apparatus of claim 41 wherein the pipe gripping apparatus is movable using a draw works.

49. The apparatus of claim 41 further comprising:

a plurality of removably securable replacement guide segments having a face;

wherein the replacement guide segments are securable to the guide retainer to together form a second generally convergent surface.

* * * * *